US008803770B2

(12) United States Patent
Jeong et al.

(10) Patent No.: US 8,803,770 B2
(45) Date of Patent: Aug. 12, 2014

(54) PIXEL AND AN ORGANIC LIGHT EMITTING DISPLAY DEVICE USING THE SAME

(75) Inventors: Jin-Tae Jeong, Yongin (KR); Shingo Kawashima, Yongin (KR)

(73) Assignee: Samsung Display Co., Ltd., Yongin-si (KR)

( * ) Notice: Subject to any disclaimer, the term of this patent is extended or adjusted under 35 U.S.C. 154(b) by 428 days.

(21) Appl. No.: 12/941,380

(22) Filed: Nov. 8, 2010

(65) Prior Publication Data

US 2012/0001893 A1 Jan. 5, 2012

(30) Foreign Application Priority Data

Jun. 30, 2010 (KR) ..... 10-2010-0062763

(51) Int. Cl.
*G09G 3/30* (2006.01)
*G09G 3/32* (2006.01)

(52) U.S. Cl.
USPC ..... 345/76; 345/82

(58) Field of Classification Search
CPC ..... G09G 3/3233; G09G 2300/0809; G09G 2320/04
USPC ..... 345/82, 76, 211, 213
See application file for complete search history.

(56) References Cited

U.S. PATENT DOCUMENTS

2003/0112205 A1 6/2003 Yamada
2005/0017934 A1 1/2005 Chung et al.
2005/0269959 A1 12/2005 Uchino et al.
2005/0285825 A1 12/2005 Eom et al.
2006/0066532 A1 3/2006 Jeong
2007/0132694 A1* 6/2007 Uchino et al. ..... 345/92
2010/0013816 A1* 1/2010 Kwak ..... 345/211
2010/0079361 A1 4/2010 Lee et al.
2010/0149160 A1 6/2010 Kimura
2012/0001896 A1* 1/2012 Han et al. ..... 345/214

FOREIGN PATENT DOCUMENTS

CN 1427382 A 7/2003
CN 1577453 A 2/2005
CN 1716367 A 1/2006

(Continued)

OTHER PUBLICATIONS

KIPO Notice of Allowance dated May 22, 2012, for Korean priority Patent application 10-2010-0062763, (1 page).
KIPO Office action dated Nov. 8, 2011, for Korean priority Patent application 10-2010-0062763, noting Korean reference previously filed in an IDS dated Dec. 22, 2010, 4 pages.

(Continued)

*Primary Examiner* — Chanh Nguyen
*Assistant Examiner* — John Kirkpatrick
(74) *Attorney, Agent, or Firm* — Christie, Parker & Hale, LLP

(57) ABSTRACT

A pixel includes an OLED between first and second power supplies; a first transistor between the first power supply and the OLED, including a gate electrode connected to a first node; a second transistor between the first transistor and a data line, including a gate electrode connected to a current scanning line; a third transistor between the first transistor and the first node, including a gate electrode connected to the current scanning line; a fourth transistor between the first transistor and the OLED, including a gate electrode connected to a light emitting control line; a fifth transistor between the second or third power supply and the first node, including a gate electrode connected to a previous scanning line; a sixth transistor between the second or third power supply and the fourth transistor, including a gate electrode connected to the previous scanning line.

14 Claims, 6 Drawing Sheets

(56) References Cited

FOREIGN PATENT DOCUMENTS

| | | | |
|---|---|---|---|
| CN | 101630481 | A | 1/2010 |
| EP | 1 496 495 | A2 | 1/2005 |
| JP | 2005-345722 | | 12/2002 |
| JP | 2006-11428 | | 1/2006 |
| JP | 2009-175716 | | 8/2009 |
| JP | 2010-26488 | | 2/2010 |
| KR | 10-2005-0052033 | A | 6/2005 |
| KR | 10-2006-0019757 | | 3/2006 |
| KR | 10-2009-0005588 | A | 1/2009 |
| KR | 10-2009-0042006 | A | 4/2009 |
| KR | 10-2009-0106162 | A | 10/2009 |
| KR | 10-2010-0009219 | A | 1/2010 |
| KR | 10-2010-0064621 | | 6/2010 |

OTHER PUBLICATIONS

U.S. Appl. No 12/967,371, filed Dec. 14, 2010, Sam-Il Han, et al., Samsung Mobile Display Co., Ltd.

European Patent Office action dated Sep. 9, 2011, for corresponding application 11171705.4, 9 pages.

KIPO Office action dated Apr. 30, 2012, for Korean Patent application 10-2010-0062764, (1 page).

KIPO Office action dated Nov. 8, 2011, for Korean Patent application 10-2010-0062764, (4 pages).

Jpo Office action dated Apr. 22, 2014, for corresponding Japanese Patent application 2010-219340, (3 pages).

SIPO Office action dated Jun. 5, 2014, for corresponding Chinese Patent application 201010620118.6, (7 pages).

* cited by examiner

PIXEL AND AN ORGANIC LIGHT EMITTING DISPLAY DEVICE USING THE SAME

CROSS-REFERENCE TO RELATED APPLICATION

This application claims priority to and the benefit of Korean Patent Application No. 10-2010-0062763, filed on Jun. 30, 2010, in the Korean Intellectual Property Office, the disclosure of which is incorporated herein by reference.

BACKGROUND

1. Field

An aspect of the present invention relates to a pixel and an organic light emitting display device using the same, and more particularly, to an organic light emitting display device using a pixel that has an improved response time.

2. Description of the Related Art

Recently, all sorts of flat panel display devices are being developed, in which the flat panel display devices have a lighter weight and a smaller volume as compared to cathode ray tube devices.

Especially, an organic light emitting display device, among the flat panel display devices, is being considered as the next generation display device because of its superior luminance and color purity. This is due to the organic light emitting display devices capability of displaying an image using an organic light emitting diode which is a self-emitting device.

The above-mentioned organic light emitting display device may be divided into a passive matrix organic light emitting display device (PMOLED), and an active matrix organic light emitting display device (AMOLED) depending on how the organic light emitting diode is driven.

The active matrix organic light emitting display device among these includes a plurality of pixels arranged at the intersection between scanning lines and data lines. In addition, each pixel includes the organic light emitting diode and a pixel circuit for driving the organic light emitting diode. The pixel circuit is typically composed of a switching transistor, a driving transistor, and a storage capacitor.

The active matrix organic light emitting display device may be useful in a portable display device, and the like, because it has an advantage that electric power consumption is low.

However, for the active matrix organic light emitting display device, it is possible that the response time is decreased due to hysteresis of the driving transistor. In other words, when pixels display white after displaying black over many frames, it is possible that the response time is decreased because a continuous off-voltage of the driving transistor during the period for displaying black, a transistor curve is shifted, and then a target luminance value is not sufficiently reached at the initial period for displaying white. Accordingly, if the response time of the pixel is slow, the definition is decreased while causing motion blur of the picture.

SUMMARY

An aspect of the present invention provides a pixel having an improved response time and an organic light emitting display device using the same.

According to one aspect of the present invention, there is provided a pixel including an organic light emitting diode connected between a first power supply that is a high potential pixel power supply and a second power supply that is a low potential pixel power supply; a first transistor that is connected between the first power supply and the organic light emitting diode, in which a gate electrode of the first transistor is connected to a first node; a second transistor that is connected between a first electrode of the first transistor connected to the first power supply and a data line, in which a gate electrode of the second transistor is connected to a current scanning line; a third transistor that is connected between a second electrode of the first transistor connected to the organic light emitting diode and the first node, in which a gate electrode of the third transistor is connected to the current scanning line; a fourth transistor that is connected between the second electrode of the first transistor and the organic light emitting diode, in which a gate electrode of the fourth transistor is connected to a light emitting control line; a fifth transistor that is connected between a third power supply that is the second power supply or a initialization power supply, and the first node, in which a gate electrode of the fifth transistor is connected to the previous scanning line; a sixth transistor that is connected between the second power supply or the third power supply and the fourth transistor, in which the gate electrode of the sixth transistor is connected to the previous scanning line; and a storage capacitor that is connected between the first power supply and the first node.

According to another aspect of the present invention, the fourth transistor may be turned on by the light emitting control signal supplied to the light emitting control line during the first period among the initialization period that the previous scanning signal is supplied to the previous scanning line.

According to another aspect of the present invention, a current path that flows from the first power supply to the second power supply or the third power supply via the first transistor, the fourth transistor and the sixth transistor may be formed during the first period among the initialization period.

According to another aspect of the present invention, the fourth transistor is turned off due to the light emitting control signal during a second period after the first period among the initialization period.

According to another aspect of the present invention, the pixel further includes a seventh transistor that is connected between the first electrode of the first transistor and the first power supply, wherein a gate electrode of the seventh transistor is connected to the light emitting control line.

According to another aspect of the present invention, the second power supply and the third power supply may be set to the same voltage source.

According to another aspect of the present invention, there is provided an organic light emitting display device including an organic light emitting diode having a scanning driver that sequentially supplies the scanning signal to the scanning lines, and supplies the light emitting control signal to the light emitting control lines that are aligned with the scanning lines, a data driver that supplies the data signal to the data lines, and the pixel unit that is arranged at the intersection of the scanning lines, the light emitting control lines and the data lines, and includes a plurality of pixels supplied with the first power supply that is a high potential pixel power supply and the second power supply that is a low potential pixel power supply, in which each of the pixels is connected between the first power supply and the second power supply; a first transistor connected between the first power supply and the organic light emitting diode, in which the gate electrode of the first transistor is connected to the first node; a second transistor connected between the first electrode of the first transistor connected to the first power supply, and the data line, in which the gate electrode of the second transistor is connected to the current scanning line; a third transistor connected between the second electrode of the first transistor connected to the organic light emitting diode, and the first node, in which the gate electrode of the third transistor is connected to the current scanning line; a fourth transistor connected between the second electrode of the first transistor and the organic light emitting diode, in which the gate electrode of the fourth transistor is connected to the light emitting control line; a fifth transistor connected between the second power supply or the third power supply that is the initialization power supply, and the first node, in which the gate electrode of the fifth transistor is connected to the previous scanning line; a sixth transistor connected between the second power supply or the third power supply and the fourth transistor, in which the gate electrode of the sixth transistor is connected to the previous scanning line; and a storage capacitor connected between the first power supply and the first node.

According to another aspect of the present invention, the scanning driver supplies the light emitting control signal that can turn on the fourth transistor to the light emitting control line during the first period among the period for supplying a previous scanning signal to a previous scanning line.

According to another aspect of the present invention, the scanning driver supplies the light emitting control signal that can turn off the fourth transistor to the light emitting control line during the second period followed by the first period among the period for supplying the previous scanning signal.

According to another aspect of the present invention, the scanning driver supplies the light emitting control signal that can turn off a fourth transistor to the light emitting control line during the third period for supplying the current scanning signal to the current scanning line from the second period followed by the first period among the period for supplying the previous scanning signal.

According to another aspect of the present invention, each pixel includes a sixth transistor being connected in parallel to the organic light emitting diode. Further, the current path, which flows along a detour to the low potential pixel power supply or the initialization power supply from the high potential pixel power supply via the driver transistor and the sixth transistor, is formed during the initialization period for supplying the initialization voltage to the first node being connected to the gate electrode of the driving transistor, so that the problem related to the reduced response time due to the hysteresis of the driving transistor can be improved while preventing the increase of the black luminance.

Additional aspects and/or advantages of the invention will be set forth in part in the description which follows and, in part, will be obvious from the description, or may be learned by practice of the invention.

BRIEF DESCRIPTION OF THE DRAWINGS

These and/or other aspects and advantages of the invention will become apparent and more readily appreciated from the following description of the embodiments, taken in conjunction with the accompanying drawings of which.

DETAILED DESCRIPTION

Figure 1:
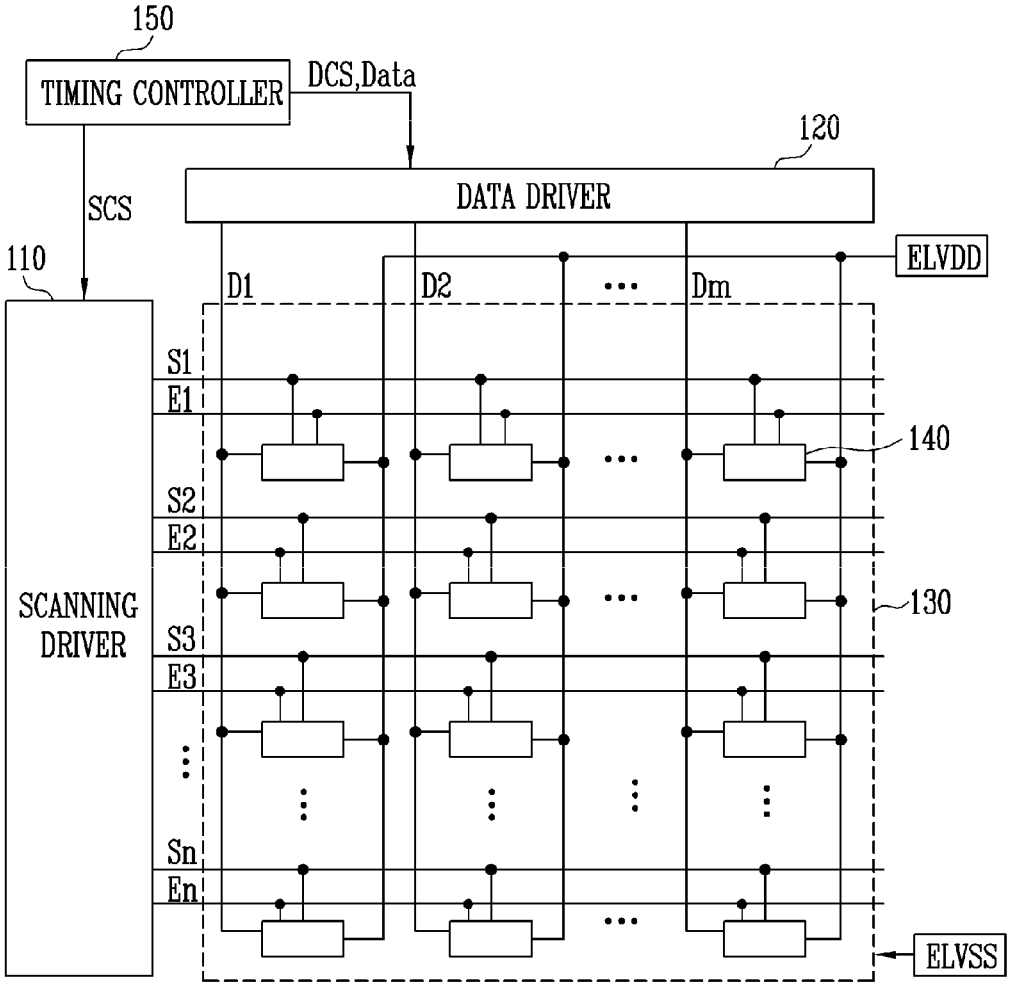
FIG. 1 is a block view roughly showing an organic light emitting display device according to an embodiment of the present invention.

Hereinafter, certain exemplary embodiments according to the present invention will be described with reference to the accompanying drawings. Here, when a first element is described as being coupled to a second element, the first element may be not only directly coupled to the second element but may also be indirectly coupled to the second element via a third element. Further, some of the elements that are not essential to the complete understanding of the invention are omitted for clarity. Also, like reference numerals refer to like elements throughout.

Hereinafter, the embodiments of the present invention will be descried in more detail with reference to the accompanying drawings.

FIG. 1 is a block view showing an organic light emitting display device according to an embodiment of the present invention. Referring to FIG. 1, an organic light emitting display device according to an embodiment of the present invention includes a pixel unit 130 including a plurality of pixels arranged at the intersection of scanning lines S1 to Sn, light emitting control lines E1 to En and data lines D1 to Dm, a scanning driver 110 for driving the scanning lines S1 to Sn and the light emitting control lines E1 to En, a data driver 120 for driving the data lines D1 to Dm, and a timing controller 150 for controlling the scanning driver 110 and the data driver 120.

The scanning driver 110 is supplied with a scanning driving control signal (SCS) from the timing controller 150. The scanning driver 110 supplied with the scanning driving control signal (SCS) generates a scanning signal, and then sequentially supplies the generated scanning signal to the scanning lines S1 to Sn.

In addition, the scanning driver 110 supplies the light emitting control signal to the light emitting control lines E1 to En that are aligned with the scanning lines S1 to Sn, corresponding to the scanning driving control signal (SCS).

However, the scanning driver 110 sequentially supplies the scanning signal to the scanning lines S1 to Sn, in which the scanning signal allows fixed transistors (not shown) that are included in the pixels 140 to be turned on. But, the scanning driver 110 supplies the light emitting control signal to the light emitting control lines E1 to En, in which the light emitting control signal allows the fixed transistors that are included in the pixels 140, at the initial period (first period) among the period for supplying a previous scanning signal to a previous scanning line on each pixel 140 basis.

Thereafter, the scanning driver 110 continuously supplies the light emitting control signal that allows the fixed transistors in the pixels to be turned on from a second period, after the first period among the period for supplying the previous scanning signal, to a third period. The third period being a period for supplying the current scanning signal to the current scanning line. After completely supplying the current scanning signal, the scanning driver 110 supplies the light emitting control signal that allows the fixed transistors to be turned on.

Meanwhile, for convenience, FIG. 1 shows that one scanning driver 110 generates and outputs all of the scanning signals and the light emitting control signal, but the aspects of the present invention are not be limited thereto.

Therefore, a plurality of the scanning drivers 110 may supply the scanning signal and the light emitting control signal from both sides of the pixel unit 130, or a driving circuit that generates and outputs the light emitting control signal and a driving circuit that generates and outputs the scanning signal may be separated as distinct driving circuits. These circuits may be called the scanning driver and the light emitting control driver. In this configuration, the scanning driver and the light emitting control driver may be formed on the same side of the pixel unit 130, or may be formed on different and/or opposite sides of the pixel unit 130.

The data driver 120 is supplied with a data driving control signal (DCS) from the timing controller 150. The data driver 120 supplied with the data driving control signal (DCS) generates a data signal corresponding to the DCS, and then supplies the generated data signal to the data lines D1 to Dm.

The timing controller 150 generates the data driving control signal (DCS) and the scanning driving control signal (SCS), corresponding to synchronizing signals supplied from the outside. The data driving control signal (DCS) generated in the timing controller 150 is supplied to the data driver 120, and the scanning driving control signal (SCS) is supplied to the scanning driver 110. In addition, the timing controller 150 supplies the data supplied from the outside to the data driver 120.

The pixel unit 130 is supplied with a first power (ELVDD) from a first power supply as a high potential pixel power and a second power (ELVSS) from a second power supply as a low potential pixel power from the outside and then supplies the first and second powers to each pixel 140. Each pixel 140 supplied with the first power (ELVDD) and the second power (ELVSS) generates light corresponding to the data signals. In addition, the pixel unit 130 may be further supplied with a third power (VINT) from a third power supply, such as an initialization power according to the configuration of the pixels 140, and the third power (VINT) may be supplied to each pixel 140.

FIG. 1 shows that the pixels 140 are connected to one scanning line, i.e., the current scanning line, but the pixels 140 can be connected to two scanning lines. For example, the pixel 140 arranged at i-th (here, i is a natural number) horizontal line may be connected to i-th scanning line Si as the current scanning line and i-1 scanning line Si-1 as the previous scanning line.

Figure 2:
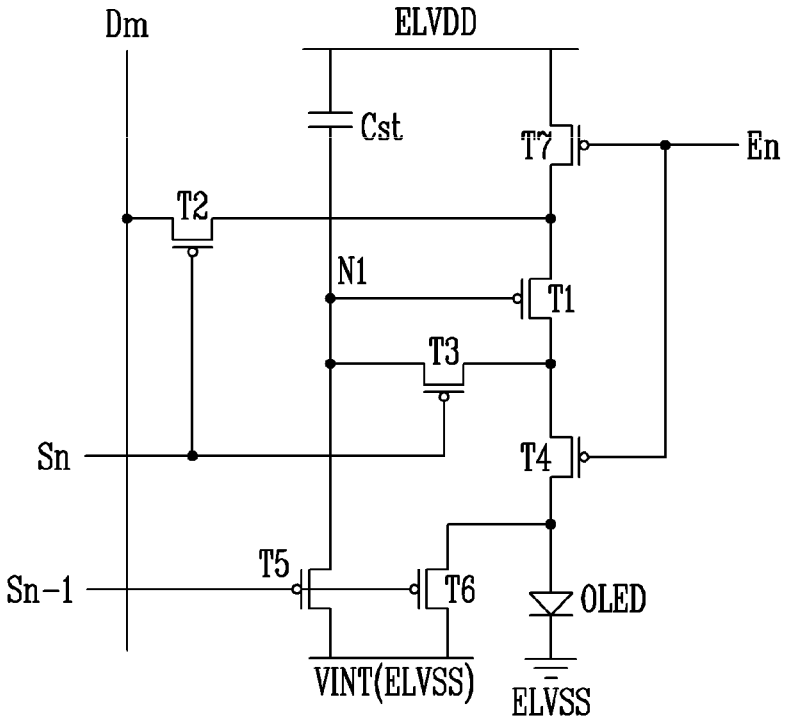
FIG. 2 is a circuit view showing pixels of an organic light emitting display device according to an embodiment of the present invention.

FIG. 2 is a circuit view showing pixels of an organic light emitting display device according to an embodiment of the present invention. For convenience, FIG. 2 shows that the pixel is arranged at n-th (here, n is a natural number) horizontal line and connected to m-th data line Dm.

Referring to FIG. 2, the pixel of the organic light emitting display device includes the organic light emitting diode (OLED) connected between a first power supply supplying the first power (ELVDD) and the second power supply supplying the second power (ELVSS), a first transistor T1 connected between the first power supply supplying the first power (ELVDD) and the organic light emitting diode (OLED), a second transistor T2 connected between the data line Dm and a first electrode of the first transistor T1, a third transistor T3 connected between a second electrode of the first transistor and a gate electrode of the first transistor T1, a fourth transistor T4 connected between the second electrode of the first transistor and the organic light emitting diode (OLED), a fifth transistor T5 connected between the second power supply supplying the second power (ELVSS) or the third power supply supplying the third power (VINT) as the initialization power and the first node N1 connected to the gate electrode of the first transistor T1, a sixth transistor T6 connected between the fourth transistor T4 and the second power supply supplying the second power (ELVSS) or the third power supply supplying the third power (VINT), a seventh transistor T7 connected between the first power supply supplying the first power (ELVDD) and the first electrode of the first transistor T1, and a storage capacitor Cst connected between the first power supply supplying the first power (ELVDD) and the first node N1.

More specifically, the first electrode of the first transistor T1 is connected to the first power supply supplying the first power (ELVDD) via the seventh transistor T7, and the second electrode of the first transistor T1 is connected to the organic light emitting diode (OLED) via the fourth transistor T4. In this configuration, the first electrode and the second electrode of the first transistor T1 are different electrodes, and for example, when the first electrode is a source electrode, the second electrode is a drain electrode. In addition, the gate electrode of the first transistor T1 is connected to the first node N1.

The above-mentioned first transistor T1 controls a driving current that is supplied to the organic light emitting diode (OLED), corresponding to the voltage of the first node N1, and functions as a driving transistor of pixels.

The first electrode of the second transistor T2 is connected to the data line Dm, and the second electrode of the second transistor T2 is connected to the first electrode of the first transistor T1. In particular, the second electrode of the second transistor T2 is connected to the first node N1 via the first and third transistors T1, T3 when the first and the third transistors T1, T3 are turned on. In addition, the gate electrode of the second transistor T2 is connected to the current scanning line Sn.

The above-mentioned second transistor T2 is turned on when the current scanning signal is supplied from the current scanning line Sn, and then delivers the data signal supplied from the data line Dm to the inside of the pixels.

The first electrode of the third transistor T3 is connected to the second electrode of the first transistor T1, and the second electrode of the third transistor T3 is connected to the first node N1 connected with the gate electrode of the first transistor T1. In addition, the gate electrode of the third transistor T3 is connected to the current scanning line Sn.

The above-mentioned third transistor T3 is turned on when the current scanning signal is supplied from the current scanning line Sn and then allows the first transistor T1 to be connected in a diode form.

The first electrode of the fourth transistor T4 is connected to the second electrode of the first transistor T1, and the second electrode of the fourth transistor T4 is connected to an anode electrode of the organic light emitting diode (OLED), like the above-mentioned organic light emitting diode (OLED). In addition, the gate electrode of the fourth transistor T4 is connected to the light emitting control line En.

The above-mentioned fourth transistor T4 is turned on or off according to the light emitting control signal supplied from the light emitting control line En such that the fourth transistor T4 forms a current path or blocks the formation of the current path in the pixels.

The first electrode of the fifth transistor T5 is connected to the first node N1, the second electrode of the fifth transistor T5 is connected to the second power supply supplying the second power (ELVSS) or the third power supply supplying the third power (VINT). In this configuration, the third power supply supplying the third power (VINT) is the initialization power supply for supplying the initialization voltage of the pixel, and may be set to the different voltage source having the different potential as the second power supply supplying the second power (ELVSS) to supply separately, or may be set to the same voltage source as the second power supply supplying the second power (ELVSS). In other words, the separate initialization power supply supplying the third power or initialization power (VINT) may be supplied according to the design structure of the pixel, or the second power supply supplying the second power (ELVSS) may be used as the initialization power supply. In addition, the gate electrode of the fifth transistor T5 is connected to the previous scanning line Sn-1.

The above-mentioned fifth transistor T5 is turned on when the previous scanning signal is supplied from the previous scanning line Sn-1, to initialize the first node N1 by applying the voltage of the second power supply supplying the second power (ELVSS) or the third power supply supplying the third power (VINT) to the first node N1.

The first electrode of the sixth transistor T6 is connected to the second electrode of the fourth transistor T4, and the second electrode of the sixth transistor T6 is connected to the second power supply supplying the second power (ELVSS) or the third power supply supplying the third power (VINT). If the second electrode of the sixth transistor T6 is connected to the second power supply supplying the second power (ELVSS), the sixth transistor T6 is connected between the fourth transistor T4 and the second power supply supplying the second power (ELVSS), to connect in parallel with the organic light emitting diode (OLED). In addition, the gate electrode of the sixth transistor T6 is connected to the previous scanning line Sn-1.

The above-mentioned sixth transistor T6 is turned on when the previous scanning signal is supplied from the previous scanning line Sn-1 such that the fourth transistor T4 is connected to the second power supply supplying the second power (ELVSS) or the third power supply supplying the third power (VINT).

The first electrode of the seventh transistor T7 is connected to the first power supply supplying the first power (ELVDD), and the second electrode of the seventh transistor T7 is connected to the first electrode of the first transistor T1. In addition, the gate electrode of the seventh transistor T7 is connected to the light emitting control line En.

The above-mentioned seventh transistor T7 is turned on or off according to the light emitting signal supplied from the light emitting control line En, and then forms the current path or blocks the formation of the current path in the pixels.

The storage capacitor Cst is connected between the first power supply supplying the first power (ELVDD) and the first node N1, and is charged with the voltage corresponding to the voltage supplied to the first node N1.

However, during the first period among the initialization period that is supplied with the previous scanning signal to the previous scanning line Sn-1, the light emitting control signal that allows the fourth transistor T4 and the seventh transistor T7 to be turned on is supplied to the light emitting control line En.

Accordingly, during the first period among the initialization period, the current path is formed, in which the current path heads toward the second power supply supplying the second power (ELVSS) or the third power supply supplying the third power (VINT) from the first power supply supplying the first power (ELVDD) via the seventh transistor T7, the first transistor T1, the fourth transistor T4, and the sixth transistor T6.

In other words, in the pixels according to an aspect of the present invention, the decrease of the response time due to the hysteresis of the driving transistor is prevented by allowing the fixed current to flow to the first transistor T1 before a data programming period and a light emitting period.

That is, when the pixels display a high luminance (such as, a white) after displaying a low luminance (such as, a black), the response time of the pixels can be improved by expressing the target luminance value at the beginning period for displaying the high luminance by allowing the fixed current to flow along a predetermined path in order to compensate the hysteresis of the first transistor T1 during the initialization period before the data programming period and the light emitting period for displaying the high luminance.

As described above, the pixel includes the sixth transistor T6 being connected to the organic light emitting diode (OLED) in parallel. In addition, during the first period among the initialization period for initializing the first node N1 being connected to the gate electrode of the driving transistor (i.e., the first transistor T1), the current path that makes a detour around the second power supply supplying the second power (ELVSS) and the third power supply supplying the third power (VINT) via the sixth transistor T6 that is connected in series to the organic light emitting diode (OLED) and the first transistor T1 from the first power supply supplying the first power (ELVDD) is formed.

Accordingly, during the initialization period, the increase of the black luminance can be prevented by preventing the emission of light from the organic light emitting diode (OLED), and also the decrease of the response time due to the hysteresis of the first transistor T1 can be improved.

Figure 3:
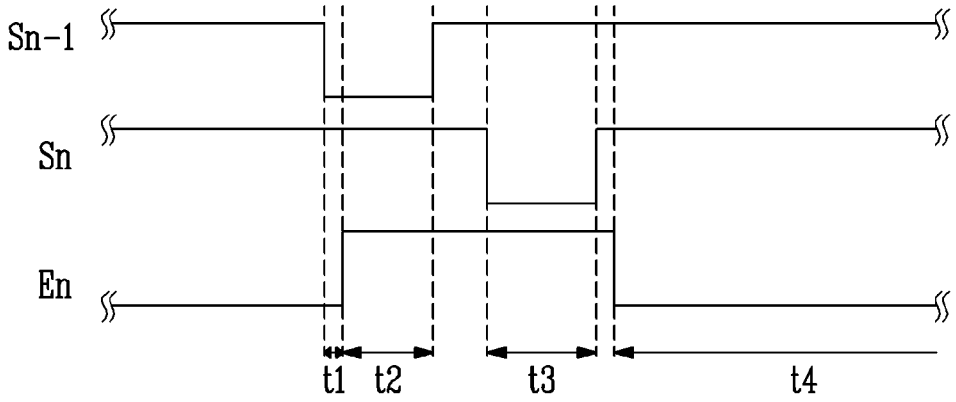
FIG. 3 is a waveform view showing driving signals for driving pixels as depicted in FIG. 2.

FIG. 3 is a waveform view showing the pixel for driving the driving signals as depicted in FIG. 2. Referring to FIG. 3, the previous scanning signal and the current scanning signal are sequentially supplied to the previous scanning line Sn-1 and the current scanning line Sn. In this configuration, the previous scanning signal and the current scanning signal are set to the voltage that can turn on the transistor included in the pixels, especially, the second and the third transistors T2, T3, and the fifth and the sixth transistors T5, T6 in FIG. 2.

In addition, the light emitting control signal that is supplied to the light emitting control line En is set to the voltage (for example, a low voltage) that can turn on the transistor included in the pixels, in particular, the fourth and the seventh transistors T4, T7 in FIG. 2, and set to the voltage (for example, a high voltage) that can turn on the fourth and the seventh transistors T4, T7 during the third period t3 for supplying the current scanning signal from the second period t2 after the initialization period (i.e., the first period t1). And then the light emitting control signal is set to the voltage that can turn on the fourth and the seventh transistors T4, T7 during the fourth period t4, i.e., the light emitting period after completely supplying the current scanning signal.

In other words, the light emitting signal of a high voltage that can turn on the fourth and the seventh transistor T4, T7 begins to supply and continues to supply the signal until end of the present scanning signal during the period for supplying the previous scanning signal.

The driving process of the pixels according to the driving signals of FIG. 3 will be described in more detail in the following sentence with reference to FIG. 4A to FIG. 4H.

FIG. 4A to FIG. 4H are circuit views and waveform views showing successively a method for driving pixels of FIG. 2 that are implemented by driving signals of FIG. 3.

Figure 4A:
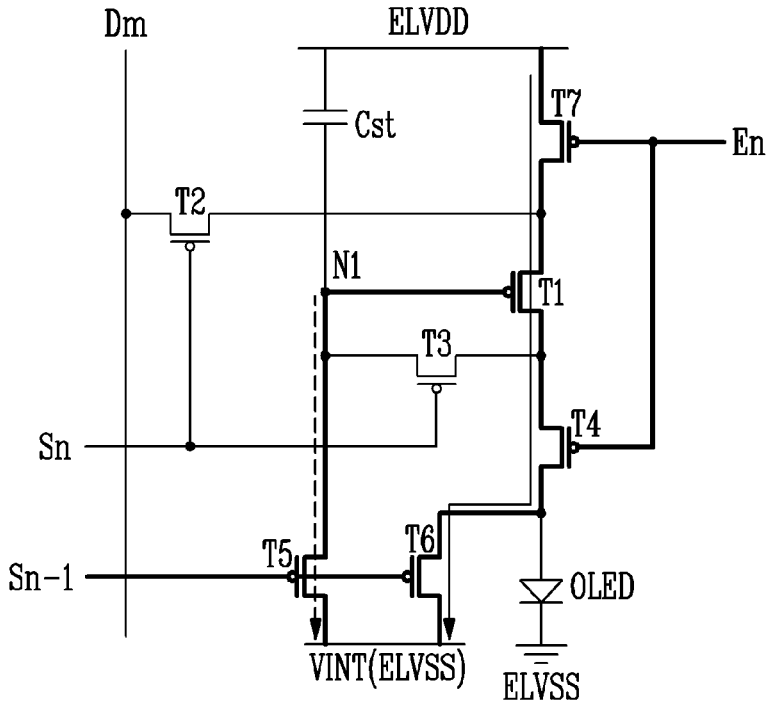
FIG. 4A to FIG. 4H are circuit views and waveform views showing successively a method for driving pixels of FIG. 2 that are implemented by driving signals of FIG. 3.
Figure 4B:
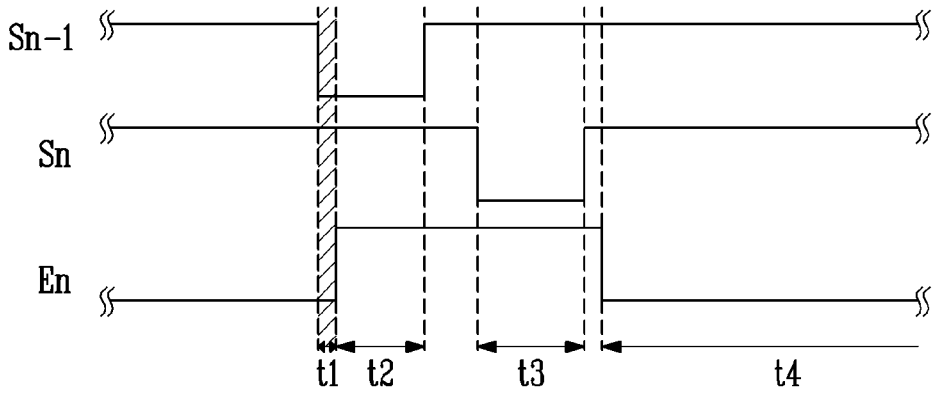

Referring to FIGS. 4A and 4B, the light emitting control signal of the low voltage is supplied to the light emitting control line En during the first period t1 among the initialization period t1, t2 for supplying the previous scanning signal to the previous scanning line Sn-1.

When the pervious scanning signal of the low voltage is supplied to the previous scanning line Sn-1, the fifth and the sixth transistors T5, T6 are turned on.

When the fifth transistor T5 is turned on, the voltage of the second power supply supplying the second power (ELVSS) or the third power supply supplying the third power (VINT) is delivered to the first node N1, when the sixth transistor T6 is turned on, the fourth transistor T4 is connected to the second power supply supplying the second power (ELVSS) or the third power supply supplying the third power (VINT). (The arrow direction in FIG. 4A is shown considering the voltage of the first node N1 having a higher voltage than the voltage of the second power supply supplying the second power (ELVSS) or the third power supply supplying the third power (VINT) before the first period t1).

In this configuration, the voltage of the second power supply supplying the second power (ELVSS) or the third power supply supplying the third power (VINT) may be set as the sufficiently low voltage that can initialize the first node N1, i.e., above a threshold voltage of the first transistor T1 rather than the lowest voltage (the highest gradation voltage when the driving transistor is a PMOS transistor) among a gradation voltage of the data signal. Therefore, during the data programming period t3 after the above period, the data signal is supplied to the first node N1 via the first transistor T1 and the third transistor T3 by forward connecting the first transistor T1 to the diode.

As described above, the voltage of the second power supply supplying the second power (ELVSS) or the third power supply supplying the third power (VINT) is set as the low voltage, the first transistor T1 is turned on during the initialization period t1 to t2 for supplying the previous scanning signal to the previous scanning line Sn-1.

Meanwhile, when the light emitting control signal of the low voltage is supplied to the light emitting control line En, the fourth and the seventh transistors T4, T7 are turned on.

Therefore, during the first period t1, the initialization voltage of the second power supply supplying the second power (ELVSS) or the third power supply supplying the third power (VINT) is applied to the first node N1, and also the current path that flows from the first power supply supplying the first power (ELVDD) to the second power supply supplying the second power (ELVSS) or the third power supply supplying the third power (VINT) via the seventh transistor T7, the first transistor T1, the fourth transistor T4, and the sixth transistor T6, is formed.

Accordingly, the fixed current flows to the first transistor T1 by applying the fixed bias voltage to each of the first and second electrodes and to the gate electrode of the first transistor T1. Therefore, the hysteresis of the first transistor T1 is compensated, and also the current flows along a detour to the sixth transistor T6 from the fourth transistor T4, so that the increase of the black luminance is prevented by preventing the light emitting of the organic light emitting diode (OLED).

In other words, the first period t1 is the period for improving the response time by preventing the decrease of the response time due to the hysteresis of the first transistor T1 by creating the flow of the fixed current by applying the bias voltage to the first transistor T1. Especially, there is an advantage that the black is clearly displayed by preventing the emission of light from the organic light emitting diode (OLED) during the above-mentioned period.

Figure 4C:
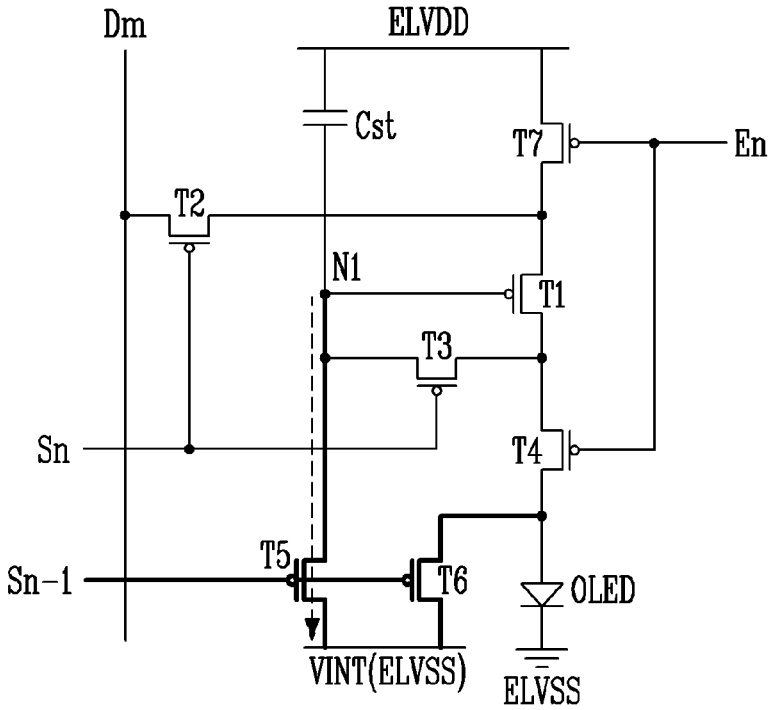
Figure 4D:
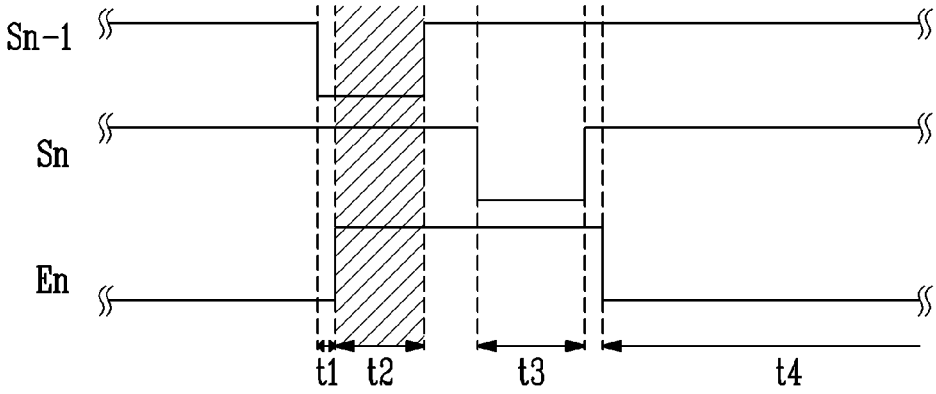

Hereinafter, as depicted in FIGS. 4C and 4D, the voltage of the light emitting control signal that is supplied to the light emitting control line En is changed to the high voltage during the second period t2 followed by the first period t1 among the initialization period t1, t2.

In other words, during the second period t2, the supply of the previous scanning signal of the low voltage is maintained in the previous scanning line Sn-1, and also the light emitting control signal of the high voltage is supplied to the light emitting control line En.

When the light emitting control signal of the high voltage is supplied to the light emitting control line En, the fourth and the seventh transistors T4, T7 are turned off, and then the current flowing via the first transistor T1 is blocked during the first period t1.

In addition, because the previous scanning signal of the low voltage is maintained during the second period t2 like the first period t1, the fifth transistors T5 is maintained in the turn-on state, therefore, the first node N1 is surely initialized with the voltage of the second power supply supplying the second power (ELVSS) and the third power supply supplying the third power (VINT).

Figure 4E:
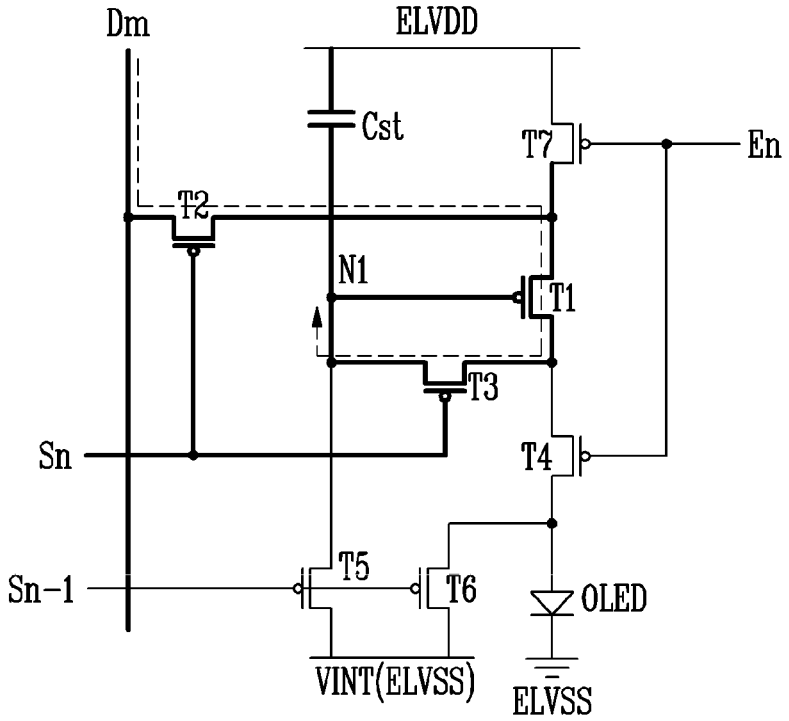
Figure 4F:
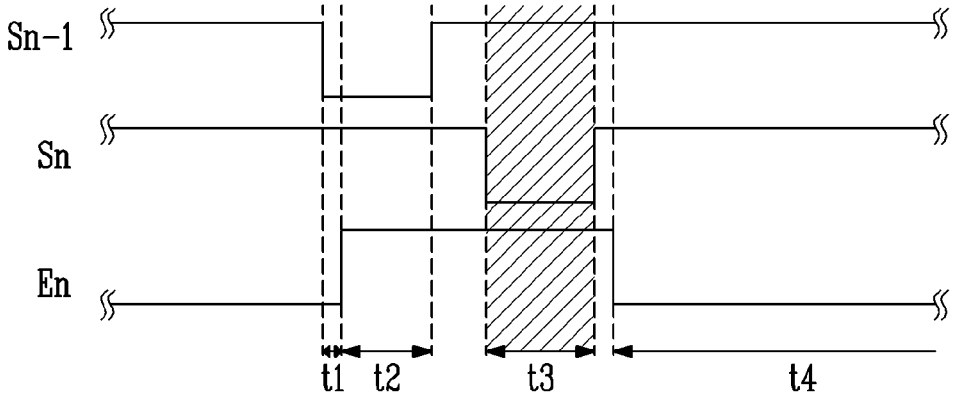

Hereinafter, as depicted in FIGS. 4E and 4F, the current scanning signal of the low voltage is supplied to the present scanning line Sn during the third period t3.

Thereafter, the second and the third transistors T2, T3 are turned on, and the first transistor T1 is in a diode-connected state by the third transistor T3.

During the above-mentioned third period t3, the data signal is supplied to the data line Dm, and the data signal is delivered to the first node N1 via the second transistor T2, the first transistor T1 and the third transistor T3. In this configuration, the first transistor T1 is in the diode-connected state, so that the different voltage of the threshold voltage of the data signal and the first transistor T1 is delivered to the first node N1.

In other words, the third period t3 is the compensation period of the threshold voltage and the data programming for supplying the voltage corresponding to the threshold voltage of the first transistor T1 and the data signal of the first node N1. Additionally, the voltage delivered to the first node N1 during the above-mentioned period is stored in the storage capacitor Cst.

Figure 4G:
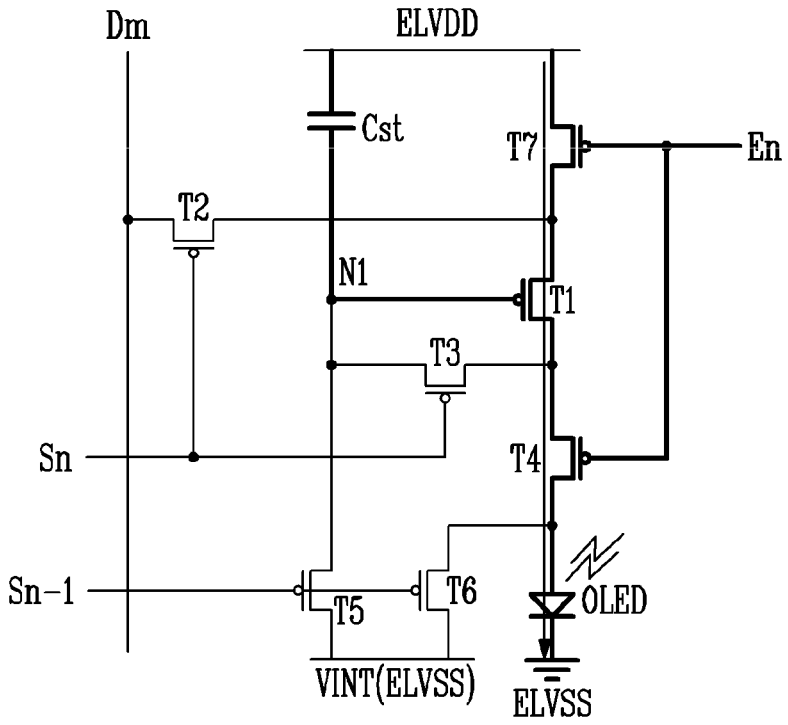
Figure 4H:
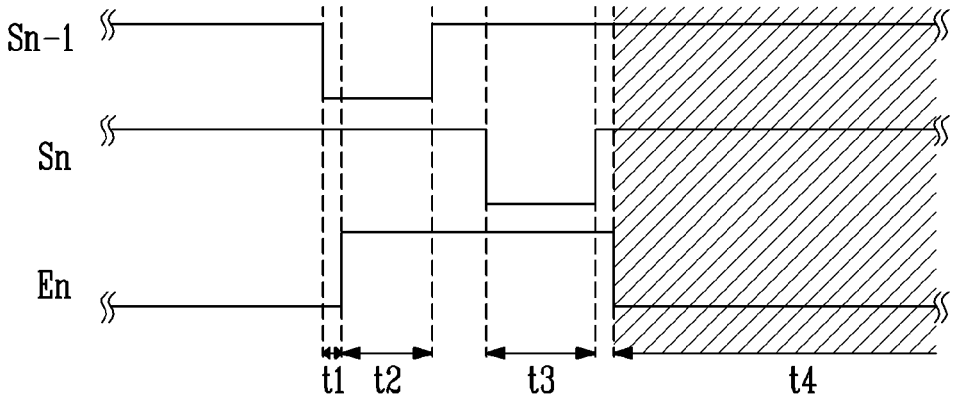

After completely supplying the current scanning signal to the current scanning line Sn, the light emitting control signal of the low voltage is supplied to the light emitting control line En during the fourth period t4 as depicted in FIGS. 4G and 4H.

Accordingly, the fourth and seventh transistors T4, T7 are turned on, the driving current flows to the second power supply supplying second power (ELVSS) from the first power supply supplying first power (ELVDD) via the seventh transistor T7, the first transistor T1, the fourth transistor T4, and the organic light emitting diode (OLED).

In this configuration, the driving current is controlled by the first transistor T1 corresponding to the voltage of the first node N1, and the voltage of the data signal and also the voltage corresponding to the threshold voltage of the first transistor T1 are stored in the first node N1 during the previous third period t3, so that the threshold voltage of the first transistor T1 is offset during the fourth period t4. Thereafter, the driving current corresponding to the data signal unrelated to the deviation of the threshold voltage of the first transistor T1 flows.

That is, the fourth period t4 is the light emitting period of the pixels, and the organic light emitting diode (OLED) emits light as the luminance corresponding to the data signal during the fourth period t4.

While aspects of the present invention have been described in connection with certain exemplary embodiments, it is to be understood that the invention is not limited to the disclosed embodiments, but, on the contrary, is intended to cover various modifications and equivalent arrangements included within the spirit and scope of the appended claims, and-equivalents thereof.

Although a few embodiments of the present invention have been shown and described, it would be appreciated by those skilled in the art that changes may be made in this embodiment without departing from the principles and spirit of the invention, the scope of which is defined in the claims and their equivalents.

What is claimed is:

1. A pixel comprising:

an organic light emitting diode connected between a first power supply and a second power supply;

a first transistor connected between the first power supply and the organic light emitting diode, the first transistor including a gate electrode connected to a first node;

a second transistor connected between a first electrode of the first transistor connected to the first power supply and a data line, the second transistor including a gate electrode connected to a current scanning line;

a third transistor connected between a second electrode of the first transistor connected to the organic light emitting diode and the first node, the third transistor including a gate electrode connected to the current scanning line;

a fourth transistor connected between the second electrode of the first transistor and the organic light emitting diode, the fourth transistor including a gate electrode connected to a light emitting control line and is turned on by a light emitting control signal supplied to the light emitting control line during a first period of an initialization period, wherein the first period and the initialization period start when a previous scanning signal supplied to the previous scanning line changes state and the fourth transistor is on, and is turned off by the light emitting control signal during a second period of the initialization period following the first period of the initialization period;

a fifth transistor connected between the second power supply or a third power supply that is an initialization power supply and the first node, the fifth transistor including a gate electrode connected to a previous scanning line;

a sixth transistor directly connected between the second power supply or the third power supply and the fourth transistor, the sixth transistor including a gate electrode connected to the previous scanning line;

a storage capacitor connected between the first power supply and the first node; and a seventh transistor connected between the first electrode of the first transistor and the first power supply, the seventh transistor including a gate electrode connected to the light emitting control line.

2. The pixel as claimed in claim 1, wherein a current path flows from the first power supply to the second power supply or the third power supply via the first transistor, the fourth transistor and the sixth transistor during the first period among the initialization period.

3. The pixel as claimed in claim 1, wherein the second power supply and the third power supply are set as a same voltage source.

4. The pixel as claimed in claim 1, wherein the sixth transistor is connected in parallel with the organic light emitting diode between the fourth transistor and the second power supply.

5. The pixel as claimed in claim 1, wherein the first power supply is a high potential pixel power supply and the second power supply is a low potential pixel power supply.

6. The pixel as claimed in claim 1, wherein the first transistor controls a driving current that is supplied to the organic light emitting diode, corresponding to a voltage of the first node, and functions as a driving transistor of the pixel.

7. The pixel as claimed in claim 1, wherein the seventh transistor is turned on or off according to a light emitting signal supplied from the light emitting control line, and forms a current path or blocks a formation of a current path in the pixel.

8. An organic light emitting display device comprising:

a scanning driver that sequentially supplies a scanning signal to scanning lines and supplies a light emitting control signal to light emitting control lines that is aligned with the scanning lines;

a data driver that supplies a data signal to data lines;

a pixel unit arranged at an intersection of the scanning lines, the light emitting control lines and the data lines, and including a plurality of pixels supplied with a first power from a first power supply, and a second power supplied from a second power supply;

wherein each pixel includes:

an organic light emitting diode connected between the first power supply and the second power supply;

a first transistor connected between the first power supply and the organic light emitting diode, the first transistor including a gate electrode connected to a first node;

a second transistor connected between a first electrode of the first transistor connected to the first power supply and a data line, the second transistor including a gate electrode is connected to a current scanning line;

a third transistor connected between a second electrode of the first transistor connected to the organic light emitting diode and the first node, the third transistor including a gate electrode is connected to the current scanning line;

a fourth transistor connected between the second electrode of the first transistor and the organic light emitting diode, the fourth transistor including a gate electrode connected to a light emitting control line, wherein the scanning driver supplies a light emitting control signal, to turn on the fourth transistor, to the light emitting control line during a first period that starts when a previous scanning signal supplied to the previous scanning line changes state and the fourth transistor is on, and wherein the scanning driver also supplies the light emitting control signal, to turn off the fourth transistor, to the light emitting control line during a second period after the first period;

a fifth transistor connected between the second power supply or a third power supply that is an initialization power supply and the first node, the fifth transistor including a gate electrode connected to a previous scanning line;

a sixth transistor connected directly between the second power supply or the third power supply and the fourth transistor, the sixth transistor including a gate electrode connected to the previous scanning line;

a storage capacitor connected between the first power supply and the first node; and a seventh transistor connected between the first electrode of the first transistor and the first power supply, the seventh transistor including a gate electrode connected to the light emitting control line.

9. The organic light emitting display device as claimed in claim 8, wherein the scanning driver continuously supplies the light emitting control signal, to turn off the fourth transistor, to the light emitting control line during the period from a second period after the first period to a third period for supplying a current scanning signal to the current scanning line among the period for supplying the previous scanning signal.

10. The organic light emitting display device as claimed in claim 8, wherein the second power supply and the third power supply are set as same voltage source.

11. The organic light emitting display device as claimed in claim 8, wherein the sixth transistor is connected in parallel with the organic light emitting diode between the fourth transistor and the second power supply.

12. The organic light emitting display device as claimed in claim 8, wherein the first power is a high potential pixel power and the second power is a low potential pixel power.

13. The organic light emitting display device as claimed in claim 8, wherein the first transistor controls a driving current that is supplied to the organic light emitting diode, corresponding to a voltage of the first node, and functions as a driving transistor of the pixel.

14. The organic light emitting display device as claimed in claim 8, wherein the seventh transistor is turned on or off according to a light emitting signal supplied from the light emitting control line, and forms a current path or blocks a formation of a current path in the pixel.

* * * * *